US006857272B2

(12) United States Patent
Summerfield et al.

(10) Patent No.: US 6,857,272 B2
(45) Date of Patent: Feb. 22, 2005

(54) FUEL DELIVERY SYSTEM

(75) Inventors: Leslie R Summerfield, Bristol (GB); Jonathan M Gregory, Cheltenham (GB); James L Boston, Bristol (GB); Peter J Harding, Bristol (GB)

(73) Assignee: ROLLS-ROYCE plc, London (GB)

( * ) Notice: Subject to any disclaimer, the term of this patent is extended or adjusted under 35 U.S.C. 154(b) by 63 days.

(21) Appl. No.: 10/183,391

(22) Filed: Jun. 28, 2002

(65) Prior Publication Data

US 2003/0014979 A1 Jan. 23, 2003

(30) Foreign Application Priority Data

Jul. 18, 2001 (GB) ..... 0117554
Apr. 24, 2002 (GB) ..... 0209295
May 2, 2002 (GB) ..... 0210014

(51) Int. Cl.[7] ..... F02C 7/288
(52) U.S. Cl. ..... 60/739
(58) Field of Search ..... 60/776, 778, 739, 60/39.281

(56) References Cited

U.S. PATENT DOCUMENTS

| | | | | |
|---|---|---|---|---|
| 3,827,460 A | | 8/1974 | Rimmer | |
| 4,027,473 A | * | 6/1977 | Baker | 60/39.281 |
| 4,417,439 A | | 11/1983 | Sepulveda et al. | |
| 4,423,595 A | | 1/1984 | McLean | |
| 4,711,085 A | | 12/1987 | Lyons | |
| 4,817,389 A | | 4/1989 | Holladay et al. | |
| 5,211,005 A | * | 5/1993 | Hovnanian | 60/800 |
| 5,284,020 A | * | 2/1994 | Brocard et al. | 60/739 |
| 5,321,949 A | * | 6/1994 | Napoli et al. | 60/739 |
| 5,329,759 A | | 7/1994 | Chan | |
| 5,680,753 A | | 10/1997 | Hollinger et al. | |
| 5,884,483 A | * | 3/1999 | Munro | 60/739 |
| 6,370,863 B2 | * | 4/2002 | Muller et al. | 60/776 |
| 6,389,800 B2 | * | 5/2002 | Badeer | 60/39.58 |
| 6,425,239 B2 | * | 7/2002 | Hoffmann et al. | 60/776 |
| 6,666,029 B2 | * | 12/2003 | Ryan | 60/776 |
| 2001/0047650 A1 | * | 12/2001 | Muller et al. | 60/39.06 |
| 2002/0050140 A1 | * | 5/2002 | Blot-Carretero et al. | 60/776 |

FOREIGN PATENT DOCUMENTS

| | | |
|---|---|---|
| EP | 0 054 400 A1 | 6/1982 |
| EP | 0 522 832 A1 | 1/1983 |
| EP | 0 802 310 A2 B1 | 10/1997 |
| EP | 1 077 349 A1 | 2/2001 |
| EP | 1 182 401 A1 | 2/2002 |
| GB | 654 122 A | 6/1951 |
| GB | 2 036 296 A | 6/1980 |
| GB | 2 041 085 A | 9/1980 |
| GB | 2 312 250 A | 10/1997 |
| GB | 2 320 063 A | 6/1998 |
| GB | 2 339 599 A | 2/2000 |
| WO | WO 02/063214 A1 | 8/2002 |

* cited by examiner

*Primary Examiner*—Ehud Gartenberg
(74) *Attorney, Agent, or Firm*—Oliff & Berridge, PLC

(57) ABSTRACT

A fuel delivery system for a gas turbine engine combustor, the combustor having at least two fuel injectors of substantially the same design. All the fuel injectors are in flow communication with a first fuel supply via a first manifold, and some but not all of the injectors are in flow communication with a second fuel supply via a second manifold. During normal operation of the gas turbine engine combustor fuel is supplied to all of the fuel injectors via the first manifold. However, during predetermined engine operating conditions a second fuel supply is used to supply fuel flow in those fuel injectors in flow communication with the second manifold.

13 Claims, 2 Drawing Sheets

FUEL DELIVERY SYSTEM

The present invention relates to a fuel delivery system. In particular the invention relates to a fuel delivery system for a gas turbine engine.

In gas turbine engines it is normal to supply fuel to a combustor from a manifold system with a plurality of outlets to maintain an even fuel distribution at all fuel flow rates. Under most engine running conditions this is desirable as it promotes combustor efficiency and alleviates thermal stress on the combustor walls and all other components downstream of the combustor.

When the proportion of fuel to air, commonly termed the Fuel Air Ratio, in the combustor is relatively low there is increased propensity for the combusting gases in the combustor to be extinguished. Relatively low gas temperatures, reduced gas pressures and non-optimum fuel air mixes are contributing factors that may result in the premature and undesirable extinction of the combustion, a phenomenon termed weak extinction. The problem is exacerbated by the manner in which the engine is required to perform during flight maneuvers. During a slam deceleration the fuel flow rate will drop to less than that required to meet the target engine speed. Hence the overall FAR will drop to very low levels, potentially beneath the weak extinction limit of the combustor.

An even fuel distribution may reduce the ability of an engine to start. Normally the means of achieving successful light up is to employ starter jets. These supply fuel to discrete locations during the start sequence to increase the relative proportion of fuel to air in the zone immediately in the vicinity of the igniter spark plug. Starter jets can suffer blockage when stagnant fuel overheats and forms deposits of solid carbon inside the component. To avoid this, a constant fuel flow, or purge, is enabled, ensuring a constant flow of fuel through the starter jet.

Some engines utilize the starter jet purge flow to keep a constant fuel rich zone in the combustor. This introduces a relatively discrete stream of fuel into the gas path. The fuel mixes with air and ignites, producing a "hot streak" of burning gas which has a significantly elevated temperature compared to the average gas temperature in the combustor. The hot streak is less prone to extinction and hence extends the ability of the whole combustor to remain alight even when the average fuel air ratio of the combustor is very low. However, the hot streak may lower the life of all components which it encounters, subjecting them to abnormally high temperatures and temperature gradients, e.g. the combustor wall, nozzle guide vane & turbine assembly. Hence employing starter jets for this purpose is undesirable. Added to this the starter jets, their manifold and installation requirements all add to the mass and complexity of the fuel delivery system. As the starter jets are exposed to high temperatures there is a tendency for them to suffer thermal fatigue and erosion resulting in material loss that degrades the long-term performance repeatability and imposes a maintenance activity to check and replace degraded units. So employing starter jets to extend the combustor weak extinction limit has significant demerit.

Accordingly the present invention provides a fuel delivery system for a gas turbine engine comprising: a combustor, a fuel supply, a first manifold, a second manifold, and a plurality of fuel injectors, whereby at least one of said fuel injectors is in direct flow communication with the first manifold, and the remainder of said fuel injectors are in direct flow communication with the second manifold, the first manifold and the second manifold are in flow communication with the fuel supply through a first flow communication means which passes fuel flow under predetermined operating conditions, otherwise the second manifold is in flow communication with the fuel supply via a second flow communication means, wherein under predetermined engine conditions fuel is supplied to all of the injectors and under all other engine conditions fuel is supplied preferentially to the fuel injectors in direct flow communication with the second manifold.

The invention increases the weak extinction limit of the combustor by increasing the Fuel Air Ratio in selected regions at the expense of overall uniform fuel distribution at predetermined engine operating conditions. As the engine operating condition is increased to higher fuel flows the degree of fueling bias to the preferred burners is reduced thus reinstating the even distribution necessary to minimize the adverse effects of hot streaks in the combustor.

The invention and how it may be constructed and operated, will now be described in greater detail with reference, by way of example, to an embodiment illustrated in the accompanying drawings, in which.

Figure 1:
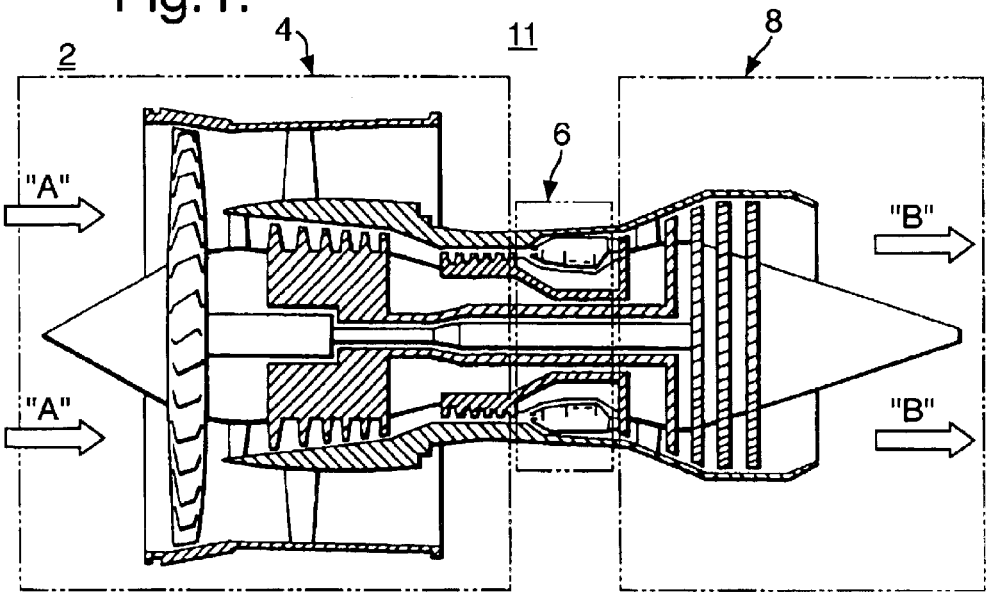
FIG. 1 is a pictorial representation of a typical gas turbine engine.

FIG. 1 illustrates the main sections of a gas turbine engine 2. The overall construction and operation of the engine 2 is of a conventional kind, well known in the field, and will not be described in this specification beyond that necessary to gain an understanding of the invention. For the purposes of this description the engine is considered to be divided up into three sections—the compressor section 4, the combustor section 6 and the turbine section 8. Air, indicated generally by arrow "A", enters the engine 2 via the compressor section 4, and a proportion of it enters the combustion section 6, the remainder of the air being employed elsewhere. Fuel is injected into the combustor airflow, which mixes with air and ignites before exhausting out of the rear of the engine, indicated generally by arrow "B", via the turbine section 8.

Figure 2:
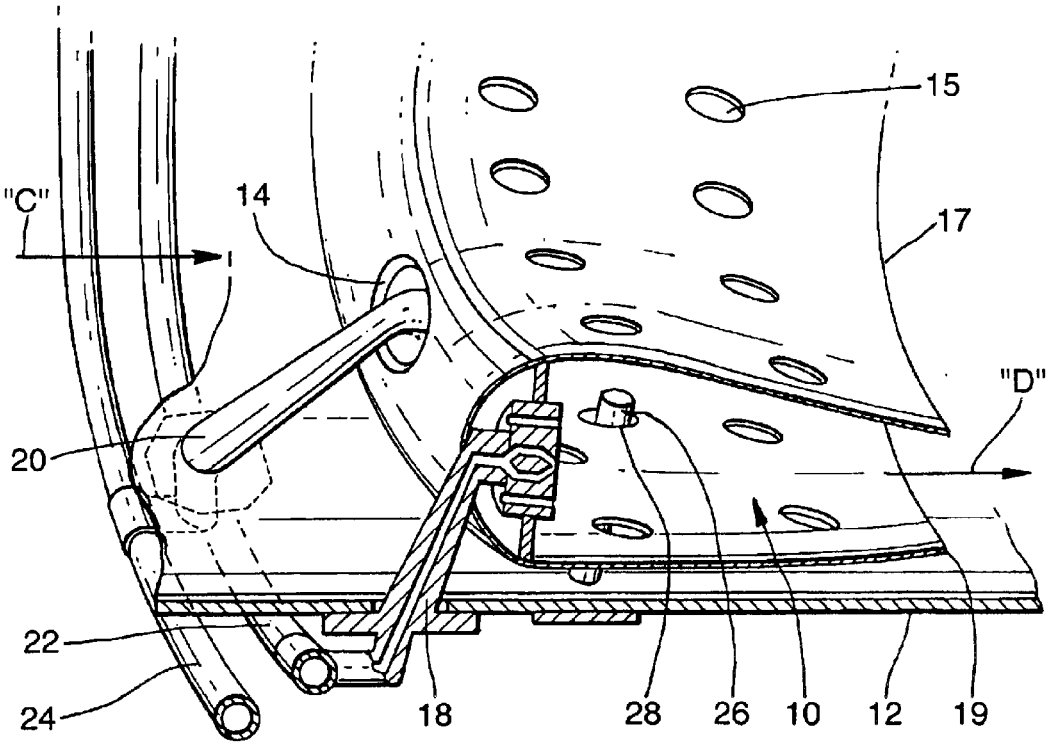
FIG. 2 shows a section of the gas turbine engine shown in FIG. 1 and having a multiple manifold fuel delivery system according to the present invention.

An enlarged view of the combustion section 6 is presented in FIG. 2. Air enters the combustion section 6 from the direction indicated by arrow "C" and, in this embodiment, is split three ways. It is directed between the combustor 10 and the engine outer casing 12, through the injector apertures 14 and between the combustor 10 and the engine inner casing 16 (not shown). Further downstream in the gas flow path, some of the air directed around the outside of the combustor 10 is directed through air intake apertures 15 in the inner and outer combustor walls, 17 and 19 respectively. Air entering the combustor 10 is mixed with fuel supplied from fuel injectors 18 and 20 that extend from a first manifold 22 and a second manifold 24 respectively through engine outer casing 12 into the combustor 10 through the injector apertures 14.

During engine startup the fuel air mix generated in the combustor 10 is ignited by an igniter plug 26 mounted, in this embodiment, on the engine outer casing 12 and which extends into the combustor 10 through the igniter plug aperture 28 in line with, and downstream of, at least one of the fuel injectors 20.

Figure 3:
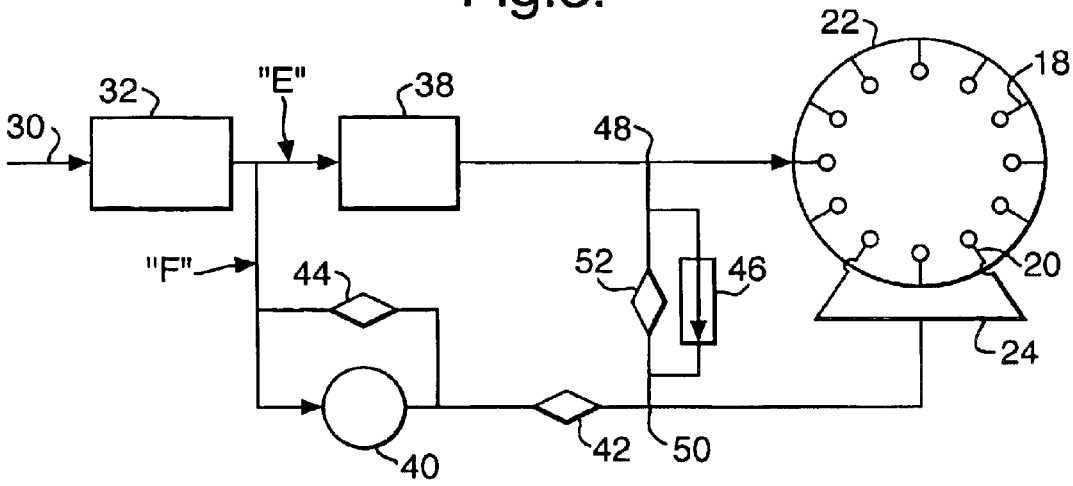
FIG. 3 shows a schematic representation of the relevant section of the fuel delivery system.

FIG. 3 illustrates the arrangement of the fuel delivery system. A fuel supply enters the system at location 30 and is delivered to a flow-metering valve 32. The fuel supply is then divided into two, providing a first fuel supply and a second fuel supply, indicated generally by arrows "E" and "F" respectively. Each is communicated to the combustor 10 via different flow paths.

The first fuel supply "E" is communicated to a pressure raising valve 38 which consists of a biased valve which opens under a predetermined fuel pressure, ensuring a minimum fuel pressure is attained in the system before fuel can flow. Below a predetermined fuel pressure, it remains shut. The pressure raising valve 38 is in flow communication with the first fuel manifold 22, which delivers the first fuel supply "E" to the fuel injectors 18.

The second fuel supply "F" is communicated through a first flow restrictor 44 to a second flow restrictor 42 and then to the second manifold 24 to supply the fuel injectors 20. A start valve 40 provides bypass means around the first flow restrictor 44.

In this embodiment the fuel injectors 18 are of substantially the same design, or identical to, fuel injectors 20. This reduces cost and complexity of the system.

Flow communication is provided between the first and second manifolds 22 and 24 respectively via a biased valve 46 which is arranged to prevent flow communication from the second manifold 24 to the first manifold 22. The flow communication is established between a point upstream in the fuel flow path of the first manifold 22 at location 48 and a point upstream of the second manifold 24 at location 50. A third flow restrictor 52 provides bypass around the biased valve 46.

In a scenario where the engine is being operated within a predetermined range (above "Idle" or "Low Power" to a "Maximum" or "High Power" rating) fuel enters the system at location 30, passes through the metering valve 32, through the pressure raising valve 38 and is delivered to the first manifold 22 and hence the injectors 18. The biased valve 46 is open to permit the transference of fuel from the first manifold 22 to the second manifold 24, hence feeding injectors 20. In this scenario the start flow valve 40 is closed, but the first flow restrictor 44 permits a reduced second fuel supply "F" to continue flowing. In some instances the fuel flow paths may be exposed to high temperatures because of their proximity the engine. Overheating can lead to the formation of carbon deposits, resulting in blockages. It is important to not have areas of stagnant fuel in areas where the temperatures are sufficient to promote carbonization. By maintaining the reduced second fuel supply "F", the formation of flow path blockages will be inhibited. The combined flow restriction due to the biased valve 46 and the second fuel manifold 24 and injectors 20 is such that, combined with the flow "F", the amount of fuel passing to injectors 20 is in the desired proportion to that passing to injectors 18.

With the start valve 40 closed at low flow conditions it is possible that the reduced second fuel supply "F" may still be at a greater pressure at location 50 than the first fuel supply "E" at location 48. When the delivery pressure of the second fuel supply "F" at location 50 has a value greater than that of the first fuel supply "E" at location 48, the biased valve 46 will be closed. In this mode of operation the total mass of fuel delivered per injector 20 via manifold 24 will be greater than that delivered per injector 18 via manifold 22. At low flow conditions (below "Idle" or "Low Power" to slightly above an "Idle" rating) the arrangement described will increase the local Fuel Air Ratio in the region of injectors 20, hence providing greater combustion stability.

At predetermined engine conditions, for example engine start-up, the fuel supply to injectors 20 is increased. Fuel enters the system from location 30, passes through the metering valve 32, through the pressure-raising valve 38 and feeds manifold 22 and the injectors 18 directly. The start valve 40 is set to open and the second fuel supply "F" passes through second flow restrictor 42 to the second manifold 24, delivering fuel to injectors 20. The second flow restrictor 42 is intended to restrict the flow to injectors 20, ensuring the difference between the fuel pressure and the combustor pressure is within desired operating parameters. The biased valve 46 is closed, but fuel is still passed through a third flow restrictor 52, which contributes to the elimination of regions of stagnant fuel and hence reduces the likelihood of fuel overheating and carbonization.

The biased valve 46 is arranged to prevent fuel flow from the second manifold 24 to the first manifold 22. It may be a simple spring biased valve which closes under the fuel back pressure from the second fuel manifold 24. Alternatively it may be operated by an electro-mechanical means (not shown) or operable by a computer control system (not shown).

Parts of the engine 2 will remain at significantly high temperatures for considerable amounts of time after engine shut down. Hence it is required that residual fuel is purged from the majority of the fuel flow path to prevent stagnant fuel in the fuel system components from forming carbon deposit blockages. This is achieved by permitting a back purge of fuel. When the fuel supply is stopped, the fuel flow to the combustor 10 will drop to such a level that the combustion will be extinguished. However, the decaying air pressure in the combustor will be sufficiently above the decaying fuel pressure to purge the fuel back through the fuel system to a collection device (not shown). This process is referred to as back purge. The third flow restrictor 52 is required to allow flow communication from the second manifold 24 to the first manifold 22 during engine shut down, which enables the purge.

Figure 4:
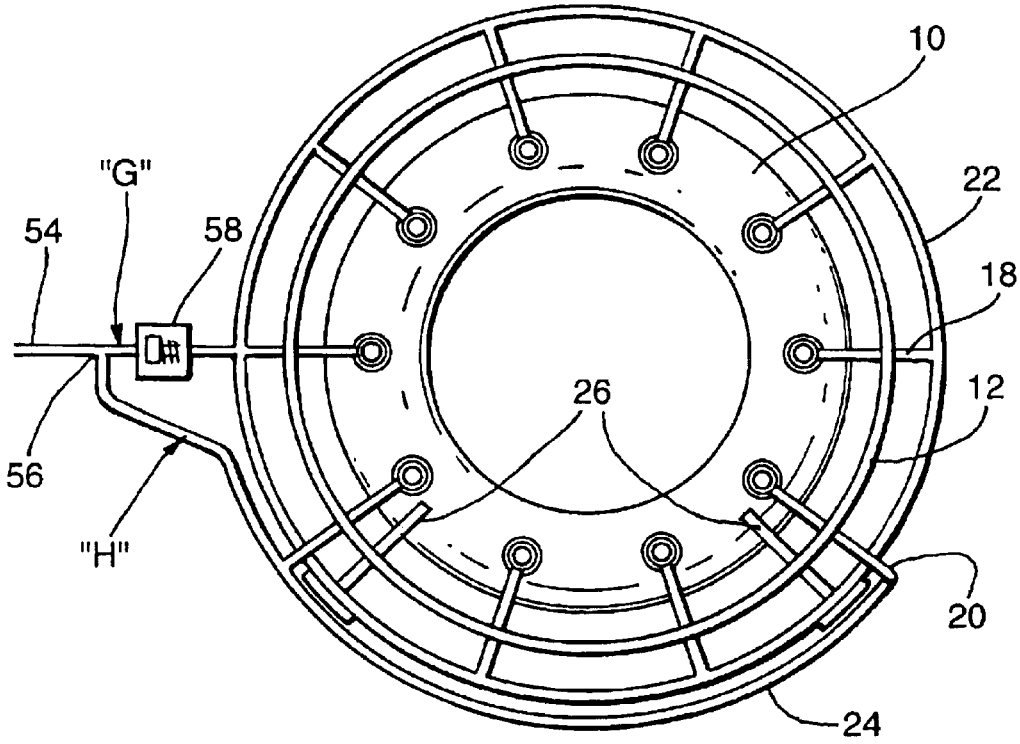
FIG. 4 shows an alternative embodiment of the fuel delivery system.

An alternative embodiment of the fuel delivery system is represented in FIG. 4. Fuel enters the system at location 54. At location 56 the fuel supply is divided into a first fuel supply "G" and a second fuel supply "H". The first fuel supply "G" is communicated to a biased valve 58 and is then delivered to the first manifold 22 and the fuel injectors 18. From location 56 the second fuel supply "F" is delivered to the second manifold 24 and the fuel injectors 20. The circumferential position and number of fuel injectors 20 may differ to that shown in FIG. 4, their location being determined by the stability requirements of the combustion system.

The valve 58 is biased, perhaps by a spring, so that it is operable by fuel delivery pressure. Alternatively it may be biased by some other means, including an electro-mechanical or purely mechanical means.

In operation, the biased valve 58 is opened under very low fuel pressures. As the first fuel supply "G" pressure level increases the biased valve 58 is opened further to communicate an increased flow of fuel. For the majority of the operating range of the engine, the biased valve 58 is fully open, with approximately the same total mass of fuel being delivered per injectors 18 and 20, via manifolds 22 and 24 respectively.

At low fuel flows, the valve 58 is partially closed, increasing the relative proportion of fuel being delivered to fuel injectors 20 via manifold 24 to that being delivered to fuel injectors 18. This raises the fuel air ratio in the region downstream of injectors 20, which extends the ignition and extinction limit of the combustion system.

The configuration shown in FIGS. 1, 2, 3 and 4 are diagrammatic. The number and positioning of the injectors, manifolds, fuel feeds, restrictors and valves may vary. Likewise the combination and configuration of these components will vary between designs.

What is claimed is:

1. A fuel delivery system for a gas turbine engine, comprising: a combustor, a fuel supply, a first manifold, a second manifold, and a plurality of fuel injectors of substantially the same design, whereby at least one of said fuel injectors is in direct flow communication with the first manifold and the remainder of said fuel injectors are in direct flow communication with the second manifold, the first manifold and the second manifold are in flow communication with the fuel supply through a first flow communication means which passes fuel under predetermined engine range, otherwise the second manifold is in flow communication with the fuel supply via a second flow communication means, wherein under predetermined engine range fuel is supplied to all of the fuel injectors and under predetermined engine conditions fuel is supplied to all the fuel injectors and additional fuel is supplied to the fuel injectors in direct flow communication with the second manifold.

2. A fuel delivery system for a gas turbine engine as claimed in claim 1, wherein the first flow communication means comprises a pressure raising valve.

3. A fuel delivery system for a gas turbine engine as claimed in claim 1, wherein the second flow communication means comprises a biased valve, a first flow restrictor and a second flow restrictor, arranged such that the second manifold is connected with the fuel supply via the second flow restrictor in series with the biased valve, said biased valve providing bypass means around the first flow restrictor such that in operation the fuel supply is used to supply fuel flow to the fuel injectors in direct flow communication with the second manifold.

4. A fuel delivery system for a gas turbine engine as claimed in claim 1, wherein the first and second manifolds are fluidly connected.

5. A fuel delivery system for a gas turbine engine as claimed in claim 4, wherein a further biased valve is connected between the first and second manifolds whereby the biased valve is operative to prevent reverse flow communication from the second manifold to the first manifold.

6. A fuel delivery system for a gas turbine engine as claimed in claim 5, wherein a third flow restrictor is arranged in communication with the first and second manifolds to provide in operation bypass means around the biased valve such that during engine shut down fuel can be back purged from the second manifold into the first flow communication means.

7. A fuel delivery system for a gas turbine engine as claimed in claim 2, wherein the second flow communication means comprises a biased valve, a first flow restrictor and a second flow restrictor, arranged such that the second manifold is connected with the fuel supply via the second flow restrictor in series with the biased valve, said biased valve providing bypass means around the first flow restrictor such that in operation the fuel supply is used to supply fuel flow to the fuel injectors in direct flow communication with the second manifold.

8. A fuel delivery system for a gas turbine engine as claimed in claim 2, wherein the first and second manifolds are fluidly connected.

9. A fuel delivery system for a gas turbine engine as claimed in claim 3, wherein the first and second manifolds are fluidly connected.

10. A fuel delivery system for a gas turbine engine as claimed in claim 8, wherein a further biased valve is connected between the first and second manifolds whereby the biased valve is operative to prevent reverse flow communication from the second manifold to the first manifold.

11. A fuel delivery system for a gas turbine engine as claimed in claim 9, wherein a further biased valve is connected between the first and second manifolds whereby the biased valve is operative to prevent reverse flow communication from the second manifold to the first manifold.

12. A fuel delivery system for a gas turbine engine as claimed in claim 10, wherein a third flow restrictor is arranged in communication with the first and second manifolds to provide in operation bypass means around the biased valve such that during engine shut down fuel can be back purged from the second manifold into the first flow communication means.

13. A fuel delivery system for a gas turbine engine as claimed in claim 11, wherein a third flow restrictor is arranged in communication with the first and second manifolds to provide in operation bypass means around the biased valve such that during engine shut down fuel can be back purged from the second manifold into the first flow communication means.

* * * * *